US009169058B1

(12) United States Patent
Ramirez et al.

(10) Patent No.: US 9,169,058 B1
(45) Date of Patent: Oct. 27, 2015

(54) TRI-FOLD EGG CARTON WITH LID SIDEWALL PROTRUSIONS

(71) Applicant: Tekni-Plex, Inc., King of Prussia, PA (US)

(72) Inventors: Richard L. Ramirez, Lawrenceville, GA (US); Mark A. Bergeron, Monroe, GA (US); Babu Kuruvilla, Griffen, GA (US); Roger P. Lichtle, Decatur, IN (US)

(73) Assignee: Tekni-Plex, Inc., Wayne, PA (US)

( * ) Notice: Subject to any disclaimer, the term of this patent is extended or adjusted under 35 U.S.C. 154(b) by 0 days.

(21) Appl. No.: 14/460,837

(22) Filed: Aug. 15, 2014

(51) Int. Cl.

| | |
|---|---|
| ***B65D 85/32*** | (2006.01) |
| ***B65D 25/54*** | (2006.01) |
| ***B65D 25/10*** | (2006.01) |
| ***B65D 43/22*** | (2006.01) |
| ***B65D 43/16*** | (2006.01) |
| ***B65D 51/18*** | (2006.01) |

(52) U.S. Cl.

CPC ..... *B65D 85/32* (2013.01); *B65D 25/108* (2013.01); *B65D 25/54* (2013.01); *B65D 43/16* (2013.01); *B65D 43/22* (2013.01); *B65D 51/18* (2013.01); *B65D 2251/009* (2013.01); *B65D 2251/0021* (2013.01); *B65D 2251/0028* (2013.01); *B65D 2251/0084* (2013.01); *B65D 2543/00296* (2013.01)

(58) Field of Classification Search

CPC .... B65D 77/0413; B65D 85/30; B65D 85/32; B65D 85/324; B65D 25/54; B65D 25/108; B65D 43/16; B65D 43/22; B65D 51/18; B65D 2251/0021; B65D 2251/0028; B65D 2251/0084; B65D 2251/009; B65D 2543/00296

USPC ..... 206/521.1, 521.3, 521.8, 521.9

See application file for complete search history.

(56) References Cited

U.S. PATENT DOCUMENTS

| | | | | | |
|---|---|---|---|---|---|
| 1,846,561 | A * | 2/1932 | Koppelman | B65D 85/324 | 206/521.1 |
| 2,569,681 | A * | 10/1951 | James | B65D 85/324 | 206/521.1 |
| 2,600,130 | A * | 6/1952 | Schilling | B65D 85/324 | 206/521.1 |
| 2,668,652 | A * | 2/1954 | Russell | B65D 85/324 | 206/521.1 |
| 2,739,750 | A * | 3/1956 | Cox | B65D 85/324 | 206/521.1 |
| 2,756,918 | A * | 7/1956 | Schwartzberg | B65D 85/324 | 206/521.1 |
| 2,843,304 | A * | 7/1958 | Reifers | B65D 85/324 | 206/521.1 |
| 2,865,548 | A * | 12/1958 | Stewart | B65D 85/324 | 206/521.1 |
| 5,927,501 | A * | 7/1999 | Herbruck | B65D 81/3294 | 206/521.8 |
| 7,258,234 | B2 * | 8/2007 | Aardema | B65D 75/24 | 206/521.1 |
| 7,766,169 | B2 * | 8/2010 | St-Onge | B65D 85/32 | 206/521.1 |

(Continued)

OTHER PUBLICATIONS

U.S. Appl. No. 13/349,360, filed Jan. 12, 2012, Trifold Egg Carton for Jumbo Eggs.

(Continued)

*Primary Examiner* — Bryon Gehman

(74) *Attorney, Agent, or Firm* — Novak Druce Connolly Bove + Quigg LLP

(57) ABSTRACT

Improvements have been made to one or more of a lid, cover, and base of a tri-fold egg carton, the improvements allowing the secure and easy loading and protection of jumbo sized eggs, in cartons that can be processed and packaged with standard equipment and in standard case sizes. Further, in one or more embodiments the improvements provide improved processability with automated labeling equipment. In one or more embodiments, the improvements allow for improved de-nesting of multiple empty cartons, prior to filling.

25 Claims, 13 Drawing Sheets

(56) References Cited

U.S. PATENT DOCUMENTS

| | | | | |
|---|---|---|---|---|
| 7,775,364 | B1 * | 8/2010 | Archambault | B65D 85/32 206/521.1 |
| 8,640,872 | B2 * | 2/2014 | Archambault | B65D 85/32 206/521.1 |
| 8,844,721 | B2 * | 9/2014 | Archambault | B65D 85/32 206/521.1 |
| 8,999,415 | B2 * | 4/2015 | Ramirez | B65D 77/0413 426/119 |
| 2006/0060493 | A1 * | 3/2006 | Marshall | B65D 75/24 206/521.1 |

OTHER PUBLICATIONS

U.S. Appl. No. 14/062,415, filed Oct. 24, 2013, Apparatus and Method for Aligning and Holding Egg Cartons.

U.S. Appl. No. 13/216,174, filed Aug. 26, 2011, Standard Footprint Egg Carton for Holding Up to Jumbo Size Eggs.

U.S. Appl. No. 13/216,083, filed Aug. 26, 2011, Egg Carton With Mating Cell and Lid Post Structure.

U.S. Appl. No. 14/460,837, filed Aug. 15, 2014, Tri-Fold Egg Carton.

U.S. Appl. No. 29/499,586, filed Aug. 15, 2014, Lid for an Egg Carton.

U.S. Appl. No. 29/499,594, filed Aug. 15, 2014, Lid for an Egg Carton.

U.S. Appl. No. 29/499,588, filed Aug. 15, 2014, Lid for an Egg Carton.

U.S. Appl. No. 14/460,889, filed Aug. 15, 2014, Method and Apparatus for Forming a Notched Hinge Connection in a Thermoformed Container.

U.S. Appl. No. 29/499,548, filed Aug. 15, 2014, Hinge Assembly for an Egg Carton.

* cited by examiner 20
33
27
92
29
120
79
63
59
50
63
310
130
210
210
60
52
210
211
63
310
63
59
13A
13A
D1
93
26
33
122
59
91
25
24
90
120
122
29
D
79
59

120
122
79
29
59

TRI-FOLD EGG CARTON WITH LID SIDEWALL PROTRUSIONS

FIELD OF THE INVENTION

The present invention relates to plastic egg cartons and more particularly to a tri-fold egg carton that will protect and can hold a variety of egg sizes including jumbo size eggs.

BACKGROUND OF THE INVENTION

Egg cartons are subjected to multiple adverse mechanical forces and environmental conditions during filling, handling, transport and use, including time spent in distribution centers, on store shelves, and in the consumer's home. They typically encounter automated equipment for filling, packaging, loading, unloading, stacking, restacking and transport. During each of these encounters, the goal is to resist egg breakage by stabilizing and holding the eggs in a protected environment, in a carton that can be manufactured in a cost effective manner.

Thus, many factors are taken into consideration in the design of egg cartons. Egg protection, resistance to stress or force, stackability, transportability, moisture resistance, aesthetic appearance, print surface area, weight, nestability/denestability, adaptability to accommodate various size eggs, and consistent manufacturing are factors which may be considered to varying degrees in the design of an egg carton.

Plastic egg cartons are available with flexible walls forming cell pockets to protect the eggs and prevent them from moving into adjacent cell pockets. However, during handling, such as while loading cases of egg cartons onto a grocery pallet, and then stacking cases 5 to 6 high on the pallet, the cases/cartons may be thrown onto the pallets and/or bump into each other, causing the eggs to come out of their cell pockets and make contact from a hard side impact blow or top compression load. Also, when scanning bar codes on lid tops, the eggs can be displaced and make contact.

Thus, there is need for an improved egg carton construction to provide better egg protection while encountering the adverse mechanical forces and environmental changes that typically occur during filling, packaging, transportation, storage and use. At the same time, there is a need to manufacture such cartons in a cost effective manner and to maintain overall carton dimensions to fit within standard case sizes and to avoid a redesign of the existing automated filling and handling equipment.

SUMMARY OF THE INVENTION

The present invention relates to an improved tri-fold plastic egg carton having one or more structural features that enable packaging of jumbo eggs in an array (e.g., 2×6) in both oriented and non-oriented positions while allowing for easy filling, closing, handling and packing into shipping containers. As used herein, "jumbo eggs" includes a full range of jumbo egg sizes from 2.50 to 2.75 ounces per egg, or 30 to 33 ounces per dozen. The carton will also accept a variety of smaller sized eggs, namely medium, large or extra large eggs. Preferably, the carton can be used with standard egg grade equipment and the carton will fit into standard cases, which include full (30 dozen) or half (15 dozen) corrugated cases, and standard plastic or wire half cases (15 dozen).

In accordance with various embodiments of the present invention, improvements have been made to one or more of a lid, cover, and base of a tri-fold egg carton. In accordance with one or more embodiments, the improvements allow the secure and easy loading and protection of jumbo sized eggs, in cartons that can be processed and packaged with standard equipment and in standard case sizes. Further, in one or more embodiments the improvements provide improved processability with automated labeling equipment. In one or more embodiments, the improvements allow for improved de-nesting of multiple empty cartons, prior to filling.

In various embodiments, improvements have been made to the lid including one or more of providing protrusions on the opposing elongated front and back sidewalls of the lid, and/or protrusions on the opposing first and second end walls of the lid, to provide improved stackability and de-nesting, clearance for larger sized eggs, and/or to provide a large flat area for printing on the end walls of the lid. In another embodiment, each corner of the lid has a stack lug located in amidportion of the corner to facilitate de-nesting of the empty stacked cartons. A cupped cylindrical portion may be provided between the stack lug and peripheral lid surface to provide additional strength to the corners. In other embodiments, the perimeter of the lid has a flat peripheral mating surface that rests on the flat peripheral mating surfaces of the cover and base while in a closed carton position. The front corners of the lid are each provided with a lip tab that reduces sliding of the base and cover in the closed position, and that provides an easily accessible finger tab for grasping to open the assembled (closed) carton.

In one or more embodiments, improvements have been made to the cover. A plurality of ridged latches are provided along an elongated front edge of the cover in the closed position to engage the lid for additional latch strength. Latches are also provided on the sides of the cover for more secure locking to the lid in the assembled (closed) position. Flats are provided in the rounded sidewalls of the end cells of the base and cover to increase the peripheralmating surfaces at each end of the base and cover to increase the compression resistance of the assembled carton. In the base, the cell dividers (between cells) are of varying heights along the length of the base, in order to increase the strength of the assembled carton, particularly during transit.

In one embodiment, a tri-fold plastic egg carton is provided for accommodating jumbo eggs, in both oriented and non-oriented positions, in individual cell pockets comprising:

a cell base, a cell cover and lid, the egg carton having in a closed position a length, a width and a height;

the cell cover having a hinged connection to one elongated edge of the cell base, aligned along the length of the carton, for pivoting between open and closed positions, the base and cover each having a complementary matrix of cells that together form a matrix of cell pockets for holding individual eggs when the cover is closed over the base;

the lid having a hinged connection to an elongated opposing edge of the base, aligned along the length of the carton, for pivoting between open and closed positions, wherein when the cover and base are in the closed position the lid can be closed over the cover to form an assembled carton in the closed position;

the lid having a top wall, depending front and rear sidewalls aligned along the length of the carton, and depending end walls aligned along the width at opposite ends of the carton;

lid sidewall protrusions spaced apart along the front and rear sidewalls of the lid, each lid sidewall protrusion extending outwardly from the sidewall over a largest diameter portion of a cover cell for accommodating a jumbo egg in the cell pocket when the lid is closed over the cover and base.

In another embodiment, the egg carton has lid end wall protrusions extending outwardly from each end wall over a largest diameter portion of a cover cell for accommodating a jumbo egg in the cell pocket when the lid is closed over the cover and base.

In another embodiment, the matrix is a 2×6 matrix and the lid sidewall protrusions include six protrusions along each of the lid front and rear sidewalls.

In another embodiment, the lid end wall protrusions each accommodate two cell pockets adjacent one end of the matrix of cell pockets.

In another embodiment, each lid end wall protrusion has a flat area for printing at the end of the carton comprising of from about 65 to about 75% of the total end wall area.

In another embodiment, the egg carton is a unitary sheet of thermoformed plastic material.

In another embodiment, cell posts are disposed at each intersection of four adjacent cells in the matrix in each of the lid and base, and each cell post of the base has a top surface that mates with a complimentary top surface of the cell post of the cover when the cover is closed over the base.

In another embodiment, the top surfaces of the cell posts have mating flat areas.

In another embodiment, the base and cover have flat peripheral mating surfaces that engage in planar relation when the cover is closed over the base.

In another embodiment, the lid has a flat peripheral mating surface that lies over and engages in planar relation the flat peripheral mating surfaces of the closed cover and base.

In another embodiment, the lid sidewalls flare outwardly from the lid top wall to the peripheral mating surface, and the lid has rounded corners between the lid sidewalls, each rounded corner having an outwardly disposed stack lug provided in a mid-potion of the rounded corner between the peripheral mating surface and top wall.

In another embodiment, each rounded corner has an outwardly cupped cylindrical portion, recessed with respect to the stack lug, between the stack lug and the lid top wall.

In another embodiment, the lid corners between the front sidewall and the two end walls each have a lip tab extending from the flat peripheral mating surface, each lip tab having a first wall that extends generally transverse to the flat peripheral mating surface to restrain movement of the base with respect to the cover in the closed position, and a second wall that extends from the first wall to form a finger tab for moving the lid to an open position away from the closed cover and base.

In another embodiment, the flat peripheral mating surface of the cover, lying adjacent the hinged connection between the base and lid when the cover is closed over the base, is spaced from the hinged connection to provide clearance for closing the lid over the cover and base.

In another embodiment, the lid front sidewall has a plurality of elongated latches aligned along the length of the lid for engaging complimentary latch surfaces on the closed cover and base, and wherein the lid latches have generally transverse ridges strengthening the latches.

In another embodiment, each cell of the cover and base has a rounded sidewall portion adapted to engage an egg, and a flat is provided in the sidewall of each cell adjacent an end wall to increase the width of the adjacent flat peripheral mating surfaces of the closed cover and base.

In another embodiment, each cell has a sidewall and the sidewalls of two adjacent cells form a cell divider to prevent contact between eggs in adjacent cell pockets.

In another embodiment, the cell dividers in the base are of varying height along the length of the carton, the base cell dividers closer to the ends of the carton having a lesser height relative to the base cell dividers closer to the middle of the carton.

In another embodiment, the closed carton is sized to accommodate jumbo size eggs of between 2.50 and 2.75 ounces per egg.

In another embodiment, the plastic is one or more of polystyrene, polyester, polyethylene, or polylactic acid, including polymers, copolymers, mixtures and blends thereof.

In another embodiment, the carton comprises a clear solid thermoformed sheet of polyester.

In another embodiment, the carton comprises a thermoformed sheet of polystyrene foam.

In another embodiment the base and cover each have a 2×6 matrix of cells for accommodating 12 jumbo eggs.

In another embodiment, the base and cover each have a 2×N matrix of cells, where N is one of 2, 3, 4, 5 or 6.

In accordance with another embodiment of the invention, a tri-fold plastic egg carton is provided for accommodating jumbo eggs, in both oriented and non-oriented positions, in individual cell pockets comprising:

a cell base, a cell cover and lid, the egg carton having in a closed position a length, a width and a height;

the cell cover having a hinged connection to one elongated edge of the cell base, aligned along the length of the carton, for pivoting between open and closed positions, the base and cover each having a complementary matrix of cells that together form a matrix of cell pockets for holding individual eggs when the cover is closed over the base;

the lid having a hinged connection to an elongated opposing edge of the base, aligned along the length of the carton, for pivoting between open and closed positions, wherein when the cover and base are in the closed position the lid can be closed over the cover to form an assembled carton in the closed position;

the lid having a top wall, depending front and rear sidewalls aligned along the length of the carton, and depending end walls aligned along the width at opposite ends of the carton;

wherein the lid sidewalls flare outwardly from the lid top wall to the peripheral mating surface, and the lid has rounded corners between the lid sidewalls, each rounded corner having an outwardly disposed stack lug provided in a mid-potion of the rounded corner between the peripheral mating surface and top wall.

In accordance with another embodiment of the invention, a tri-fold plastic egg carton is provided for accommodating jumbo eggs, in both oriented and non-oriented positions, in individual cell pockets comprising:

a cell base, a cell cover and lid, the egg carton having in a closed position a length, a width and a height;

the cell cover having a hinged connection to one elongated edge of the cell base, aligned along the length of the carton, for pivoting between open and closed positions, the base and cover each having a complementary matrix of cells that together form a matrix of cell pockets for holding individual eggs when the cover is closed over the base;

the lid having a hinged connection to an elongated opposing edge of the base, aligned along the length of the carton, for pivoting between open and closed positions, wherein when the cover and base are in the closed position the lid can be closed over the cover to form an assembled carton in the closed position;

the lid having a top wall, depending front and rear sidewalls aligned along the length of the carton, and depending end walls aligned along the width at opposite ends of the carton;

the lid having rounded corners between the lid sidewalls and end walls, the base and cover having flat peripheral mating surfaces that engage in planar relation when the cover is closed over the base, the lid having a flat peripheral mating surface that lies over and engages in planar relation the flat peripheral mating surfaces of the closed cover and base, and wherein the lid corners between the front sidewall and the two end walls each have a lip tab extending from the flat peripheral mating surface, each lip tab having a first wall that extends generally transverse to the flat peripheral mating surface to restrain movement of the base with respect to the cover in the closed position, and a second wall that extends from the first wall to form a finger tab for moving the lid to an open position away from the closed cover and base.

These and other features of the invention will be better understood through a study of the following detailed description and accompanying drawings.

DETAILED DESCRIPTION OF THE INVENTION

Referring generally to the figures, a tri-fold egg carton 10 is shown which is formed to accommodate 12 jumbo sized eggs in a 2×6 matrix of cell pockets. The egg carton 10 is illustrative of the inventive features disclosed herein.

The teachings of this disclosure may be equally applied to forming different sized egg cartons, including 4-egg, 6-egg, split-6, and 8-egg cartons.

Figure 1:
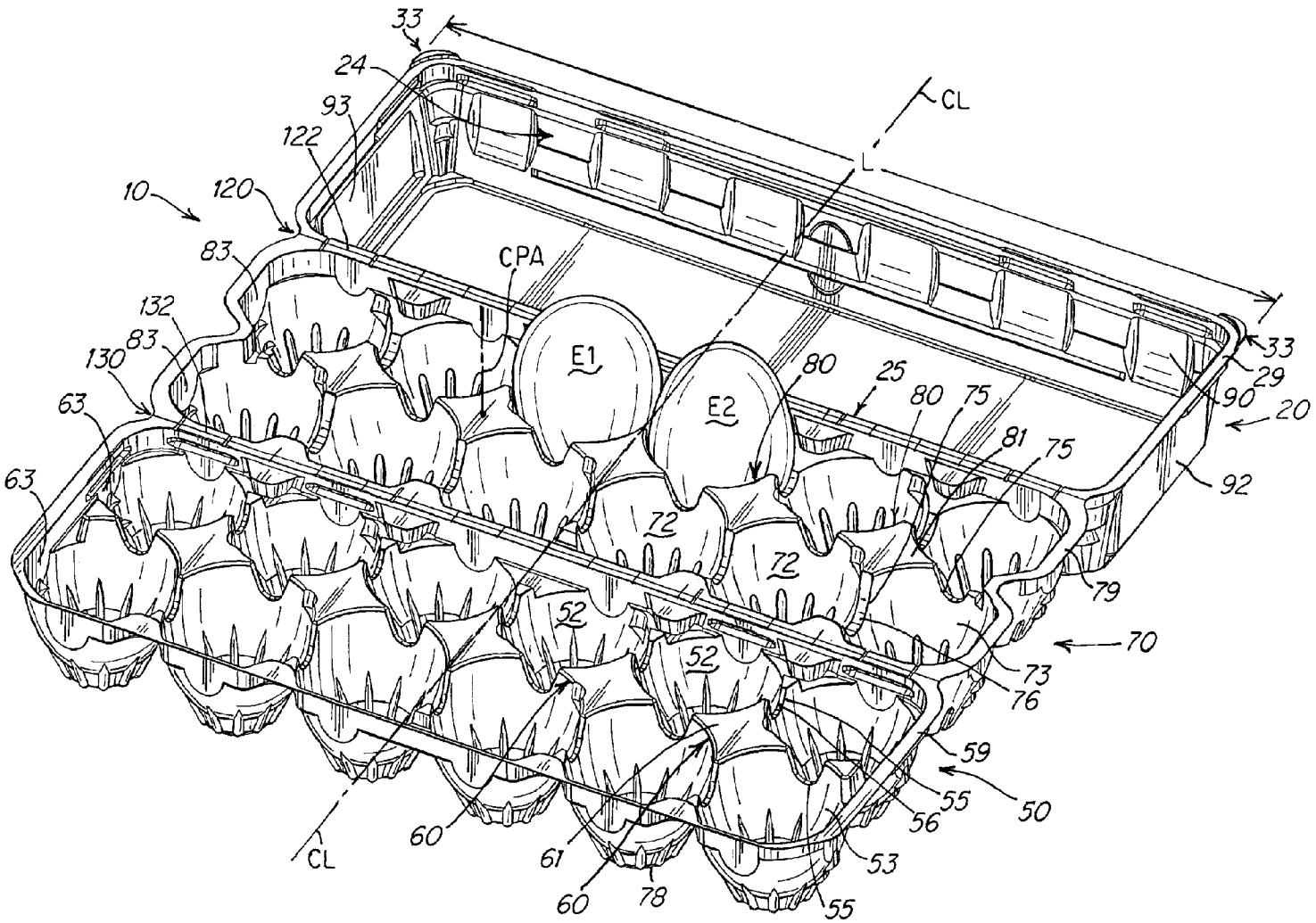
FIG. 1 is a top perspective view of an open tri-fold egg carton formed in accordance with one embodiment of the invention.
Figure 4:
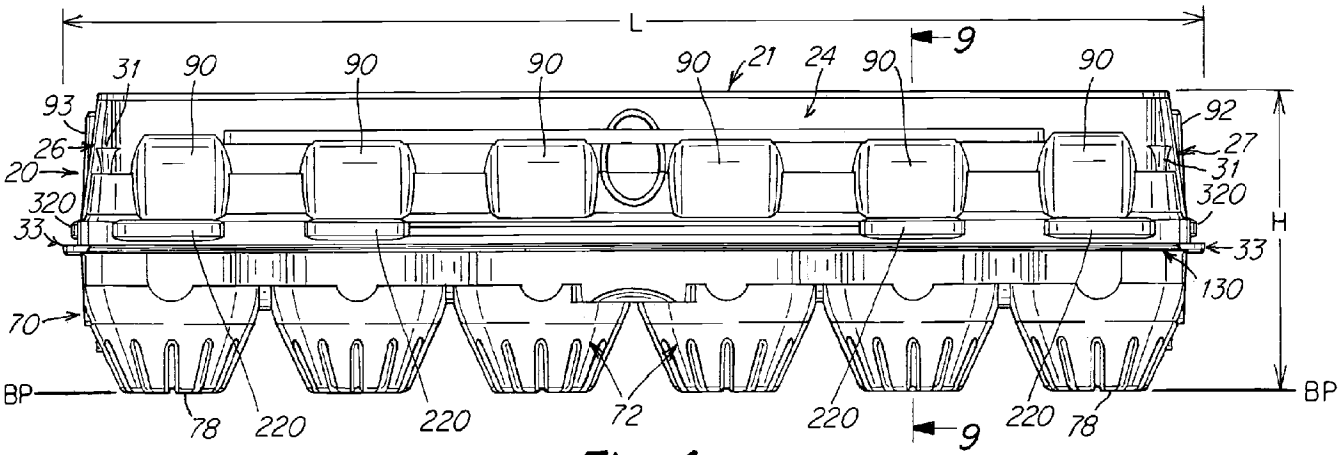
FIG. 4 is a front elevational view of the closed carton of FIG. 3.
Figure 5:
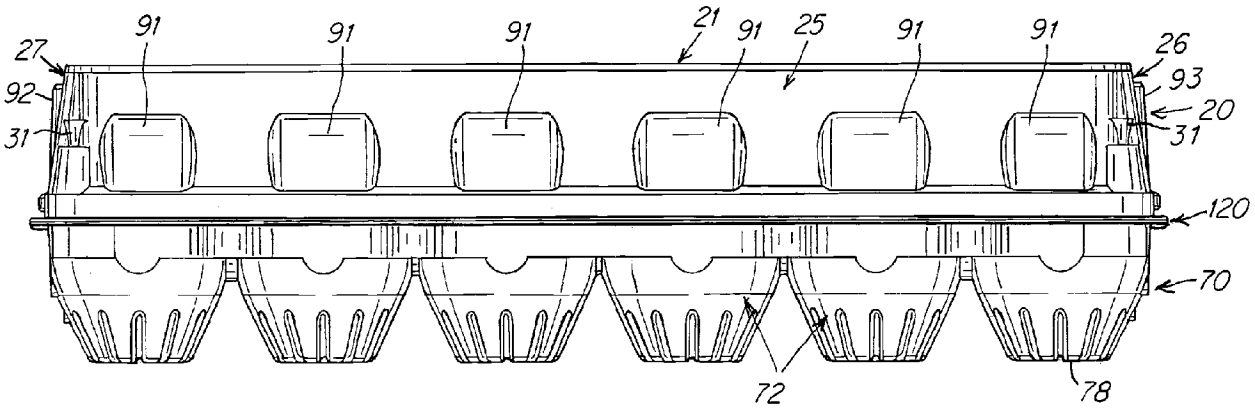
FIG. 5 is a rear elevational view of the closed carton of FIG. 3.
Figure 6:
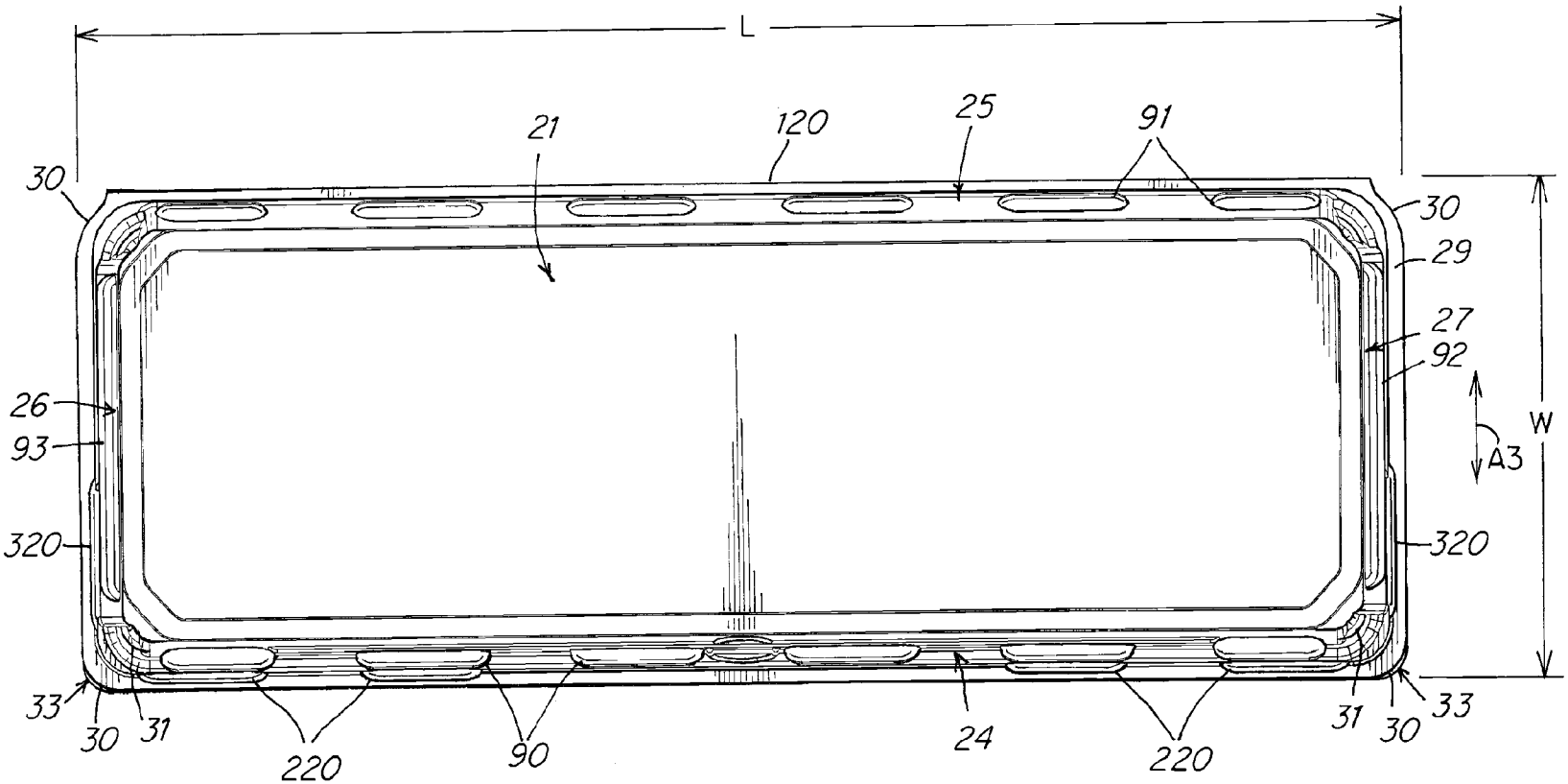
FIG. 6 is a top plan view of the closed carton of FIG. 3.

The egg carton 10 is formed with a lid 20, a cover 50 and a base 70 (FIG. 1). The closed carton has a length L, width W and height H as shown in FIGS. 4-6. The base 70 and cover 50 each have a complimentary 2×6 array of twelve cells (72 and 52, respectively) which together, when the cover is closed over the base (FIG. 2), form cell pockets 140, each cell pocket holding an individual egg E. The cell pockets can hold various sized eggs, but will each accommodate a jumbo sized egg in either an oriented (E1 in FIG. 1 and FIG. 9, left side) or non-oriented (E2 in FIG. 1 and FIG. 9, right side) position. It is contemplated that various sized eggs can be inserted into a base cell, in one or both of an oriented and non-oriented position. An egg has a height extending between a large end and a small end of the egg, and a maximum egg diameter, in a direction transverse to the egg height. In an oriented position in the cell pocket, the small end of the egg is disposed toward the bottom wall of the base cell, with the maximum egg diameter disposed away from the bottom wall of the base cell, whereas in the non-oriented position the egg is oppositely disposed in the base cell.

Figure 2:
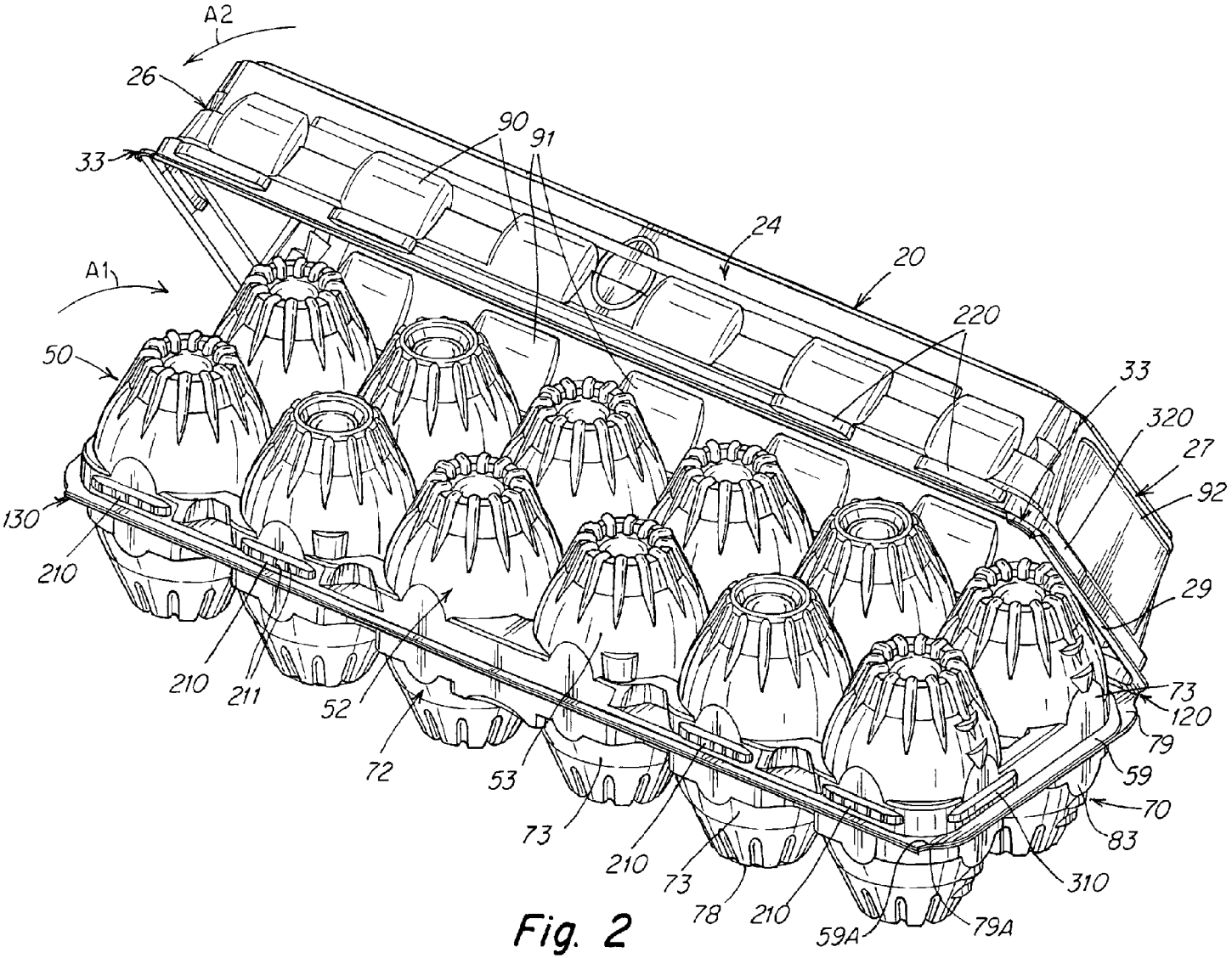
FIG. 2 is a top perspective view of the carton of FIG. 1 in a partially closed position.
Figure 3:
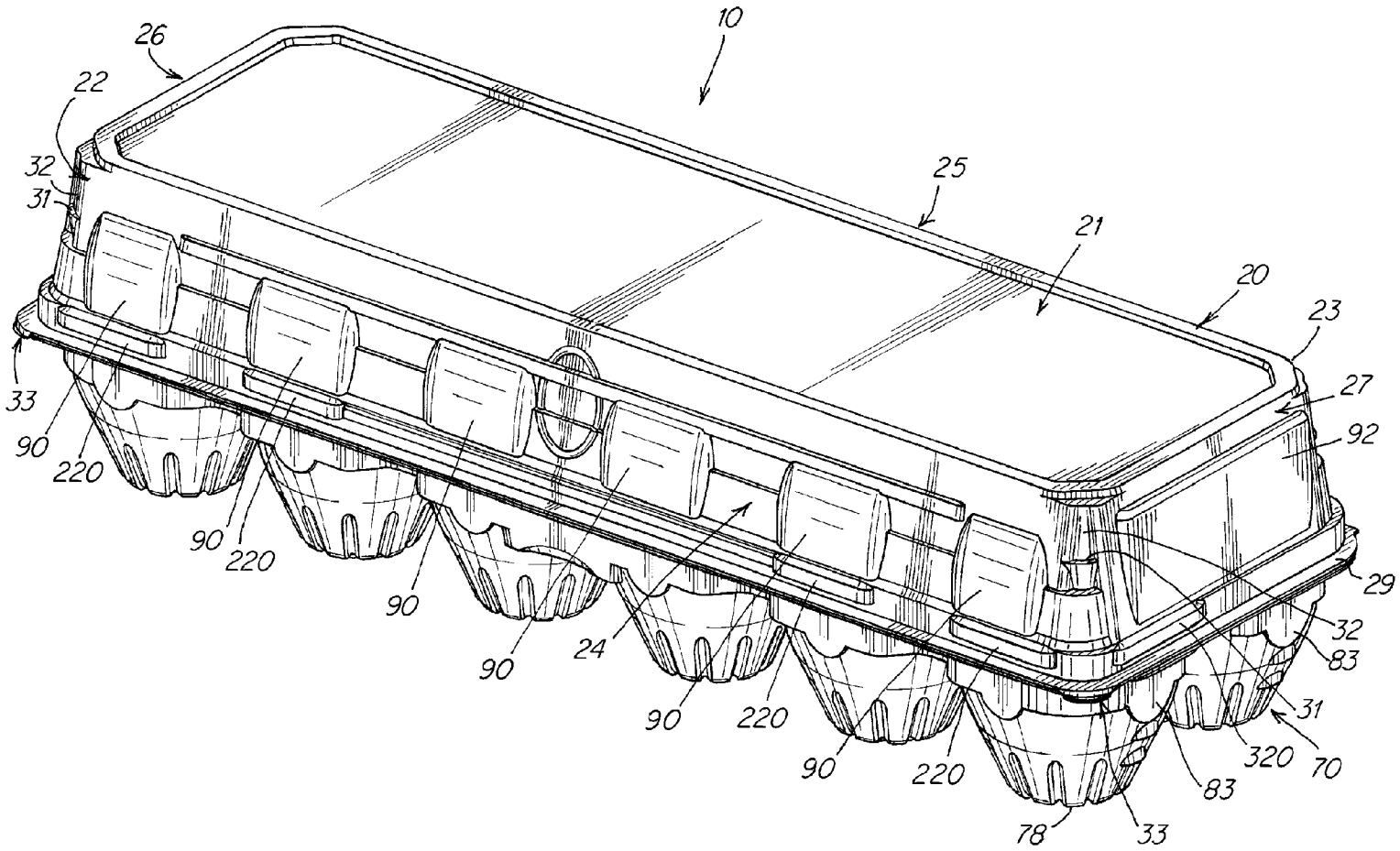
FIG. 3 is a top perspective view of the carton of FIG. 1 in a fully front/closed position.

The lid 20 and the base 70 are connected along one elongated edge of the base (in the length L direction) by an elongated hinge area 120 including a hinged connection 122 which allows for relative rotation there between, whereby the lid 20 is capable of rotating from an open position, as shown in FIG. 2, to a closed position, as shown in FIG. 3. The carton 10 further includes an elongated hinge area 130 and hinged connection 132 along the opposing edge of the base 70, between the base and cover, which allows for relative rotation of the cover over the base.

When the cover is closed over the base (see arrow A1 in FIG. 2) the complementary matrix of cells 72, 52 together form a 2×6 matrix of cell pockets 140 for holding individual eggs. The lid can then be closed over the assembled base and cover (see arrow A2) to form the assembled (closed) carton as shown in FIG. 3. The entire egg carton 10 is unitarily molded from a sheet of plastic material, wherein the lid 12, the base 70, the cover 50, and the hinge areas 120, 130 are all formed from a single sheet of (e.g., thin gauge) thermoformable plastic material.

Various features of the lid 20 are more clearly shown in FIG. 3. The lid is formed to include a generally flat planar top wall 21 and a depending sidewall 22 extending from the perimeter 23 of the top wall 21 toward a base plane BP on which the closed carton rests (FIG. 4). The lid sidewall generally defines a rectangular shape including opposing elongated (in the L direction) front and rear sidewalls 24, 25 and opposing end walls 26, 27 (in the W direction) joined by four rounded corners 30.

The lid has a generally flat peripheral surface 29 extending around its entire perimeter (also referred to as a trim edge), the flat peripheral surface lying generally in a plane parallel to the base plane BP on which the lowermost base portions 78 (or feet) of the base cells rest (FIG. 4). The base and cover also have generally flat peripheral mating surfaces 79, 59 extending around their perimeters. These peripheral surfaces form supporting surfaces, which engage in planar relation, strengthen the carton against compressive forces applied in the height H direction. More specifically, when the carton is closed, the base and cover flat peripheral mating surfaces 79, 59 engage and the flat peripheral mating surface 29 of the lid then rests on the opposite side of the flat peripheral surface 59 of the cover (see FIG. 15A). These overlapping peripheral surfaces 29, 59, 79 of the lid, cover and base thus absorb much of the compressive forces applied to the closed carton, such as when multiple cartons are stacked in a display case, or a shipping case, and when multiple cases or containers (e.g., each holding a stack of cartons) are stacked one on top of the other.

The lid corners include several features of the present invention. First are four stack lugs 31, one provided in a mid-height portion of each corner to facilitate de-nesting of the cartons. Second, a cylindrical generally cupped portion 32 is provided between each stack lug and the top wall 21, providing additional strength to the lid corners. Another new feature is provided at each of the two front corners of the lid, namely a projecting lid tab 33 that provides two important functions. First, it restricts or eliminates transverse movement (see arrow A3 in FIG. 6) of the over on the base (e.g., sliding along the mating peripheral surfaces 59, 79), and thus holds the assembled carton more securely, minimizing egg movement and unwanted compressive forces. Second, it provides a tab under which the user's finger can be slid to easily open the carton by lifting the lid from the assembled cover and base.

Figure 14:
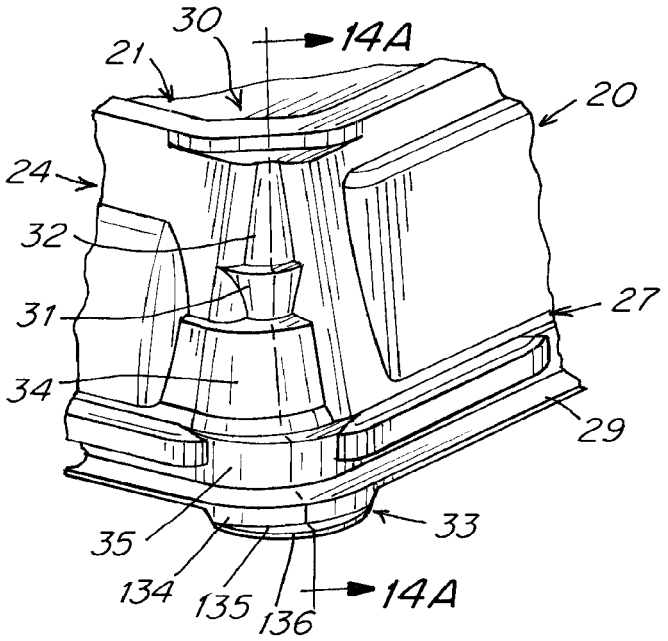
FIG. 14 is a fragmentary perspective view of a corner of the carton of lid FIG. 12 showing a stack lug and cupped cylindrical portion.
Figure 14A:
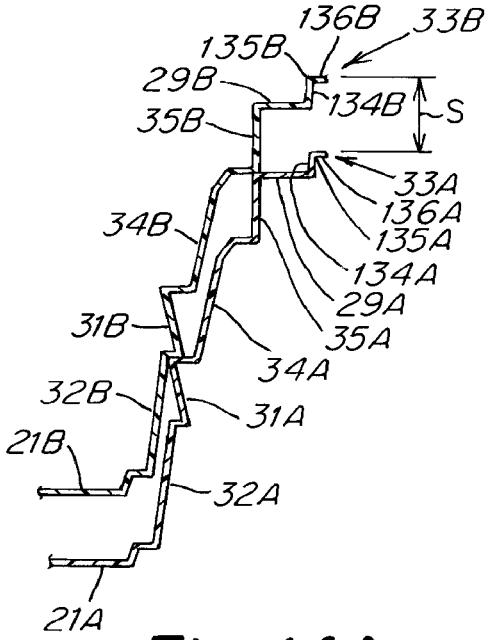
FIG. 14A is a cross sectional view taken along 14A-14A of FIG. 14 but showing the stacked spacing S of the corner lids of two nested cartons.

FIGS. 14 and 14A illustrate these lid corner features in greater detail. In the present embodiment, each lid corner 30 has a generally rounded cross-sectional profile, and extends between the elongated front sidewall 24 (or rear sidewall 25) and an adjacent shorter end wall 26, 27. Each corner flares generally radially outwardly (toward the exterior of the assembled carton) in a direction moving from the top wall 21 of the lid to the peripheral surface 29 of the lid. This rounded and flared corner is interrupted by several steps that provide strength and rigidity to the corner, whereby the four corners bear most of the compressive force when the assembled and filled egg cartons are stacked in cases, baskets, crates, or other grocery store display cases during transit and display. The stack lug 31 has been added to a mid-portion (in the H direction) of the corner, its lowermost edge lying roughly halfway between the lid top wall 21 and lid peripheral surface 29. Above the stack lug (between the top wall and stack lug) is a cupped cylindrical portion 32, which is flared in the H direction and bowed outwardly for strength, but recessed (toward the carton interior) with respect to the stack lug. Below the stack lug is another larger diameter cupped portion 34, also bowed outwardly. Adjacent the flat peripheral surface 29 is a further outwardly bowed cup portion 35. As shown in FIG. 14A, when the lids of two empty and open cartons 20A, 20B are nested, the opposing edges of the middle stack lugs 31A, 31B are in planar engagement to limit the surface contact between the corners of the adjacent nested cartons and thus facilitate de-nesting of the cartons. As a result, the outermost portion 136B of the lid tab 33B of the top carton is spaced above the corresponding portion 136A of the lid tab 33A of the lower carton a distance S, as shown in FIG. 14A.

Figure 7A:
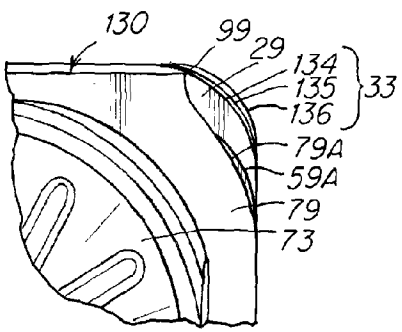
FIG. 7A is an enlarged detail view of the lip tab area encircled by arrows 7A-7A in FIG. 7.
Figure 7B:
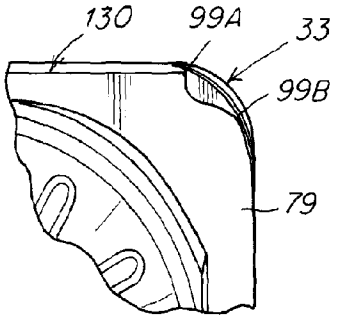
FIG. 7B is an enlarged detail view of a lip tab similar area of an alternative embodiment.
Figure 7:
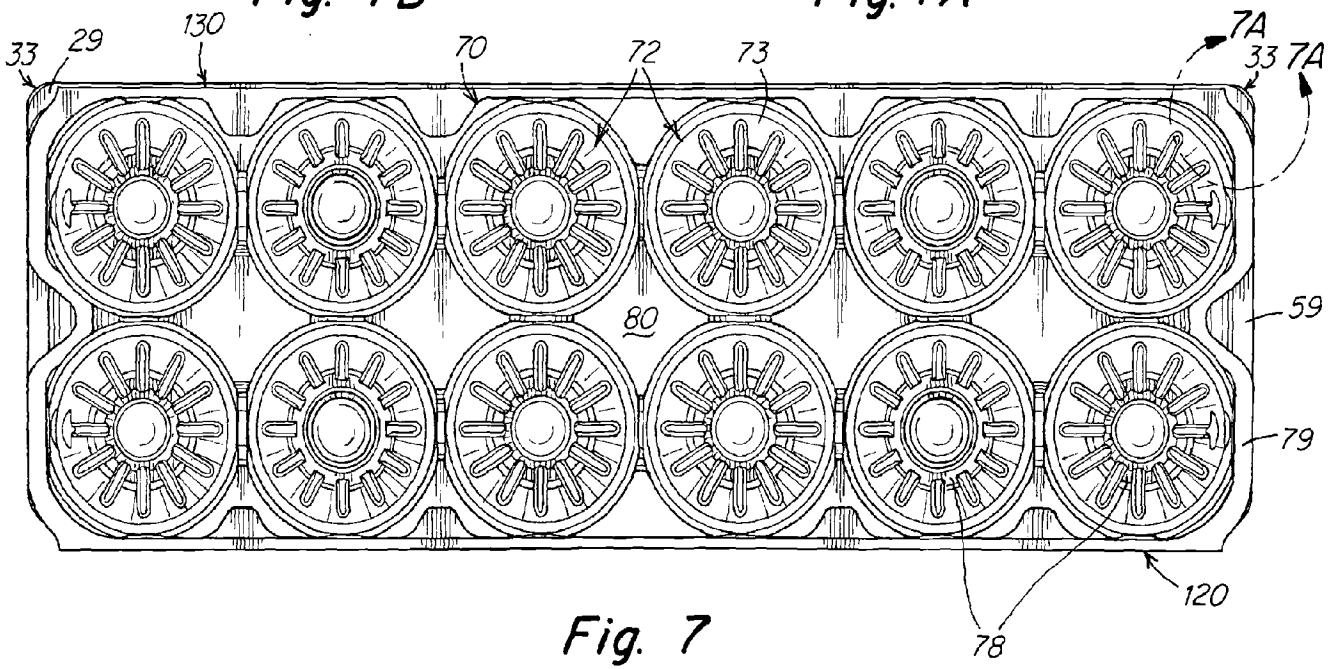
FIG. 7 is a bottom plan view of the closed carton of FIG. 3.
Figure 15:
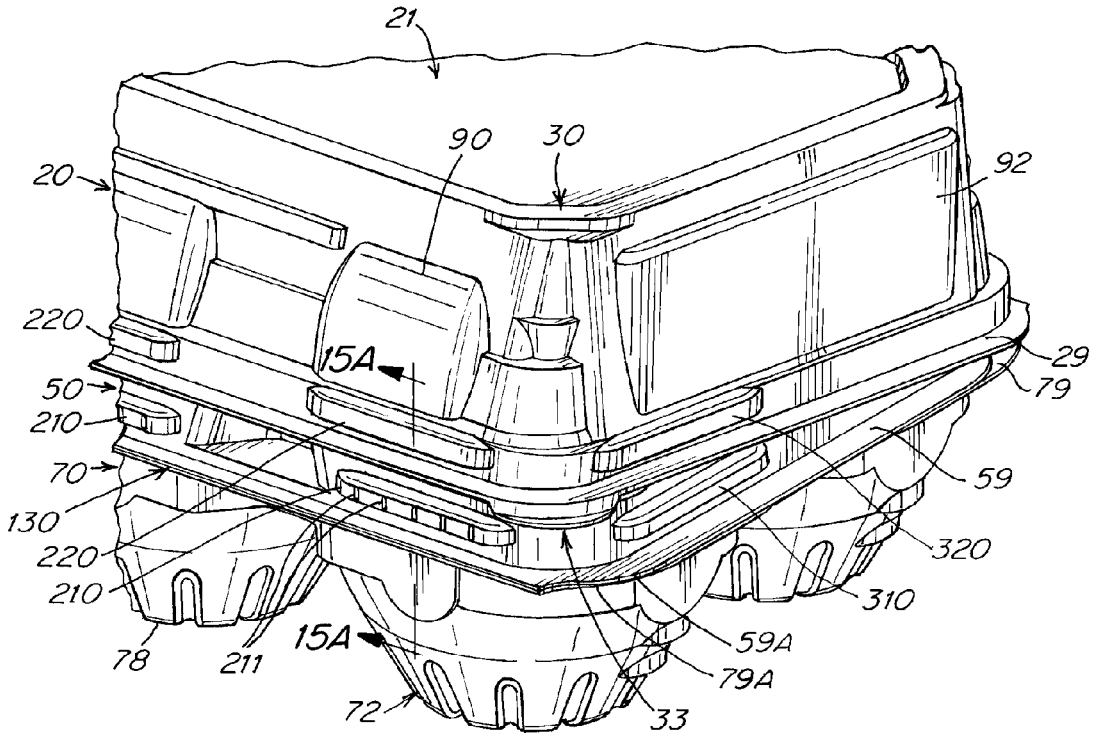
FIG. 15 is a fragmentary perspective view of front and side latches on the lid and cover of the carton of FIG. 12.

Further details of the two front corner lid tabs are best shown in FIGS. 2, 7, and 15. In the partially open position of FIG. 2, the corner lid tab 33 includes a first wall 134 projecting downwardly from (transverse to) the flat peripheral surface 29 that extends around the four sides of the lid. This first wall restricts sliding movement between the closed cover and base. The corner lid tab 33 includes a shoulder 135 between the first wall 134 and a second wall 136, the second wall 136 being generally transverse to the first wall 134. The second wall 136 provides a finger tab for opening the carton, as described below.

More specifically, at the mating corners of the assembled cover and base, the flat peripheral mating surfaces 59, 79 of the cover and base are engaged in planar relation, and at the front two corners there is a rounded indent 59A, 79A which allows the user to insert a finger below the indents to engage second wall 136 and release the lid tab 33. FIG. 7A is an enlarged detail view of this area, shown from below. In a first embodiment shown in FIG. 7A, there is only one point of contact 99 between the junction of the cover-base hinge 120 and the indented corners 79A, 59A of the peripheral surfaces on the base and cover, and the lid tab 33. In an alternative embodiment shown in FIG. 7B, two points of contact 99A, 99B are provided, including a second point spaced apart from the first point. The embodiment of FIG. 7B, with two spaced apart points of contact, will restrain movement in both the longitudinal (length L) and lateral (width W) directions of the base and cover in the assembled carton, relative to the lid. Again, reducing such movement helps prevent undo compressive forces being applied to the eggs held in the closed carton, particularly during transit when there is substantial movement of the cartons.

Returning to FIGS. 2, 4 and 5, a further feature of the invention is shown in which outwardly extending protrusions 90-93 are provided in all four sidewalls of the lid. Along each of the elongated front and rear sidewalls, a plurality (here six) spaced apart protrusions 90, 91 strengthen each of the front and rear sidewalls 24, 25 of the lid respectively and also expand the capacity of the cell pockets immediately adjacent (underneath) the protrusions. Thus, the cell pockets can be enlarged at their widest diameter point (across the width of the egg E), to accommodate the largest size jumbo eggs. One large outwardly extending end wall protrusion is also provided at each of the end walls 26, 27 of the lid. Each end wall protrusion 92, 93 accommodates two end cell pockets underneath the protrusion, and also provides an enlarged flat planar area for printing on the carton.

Figure 8:
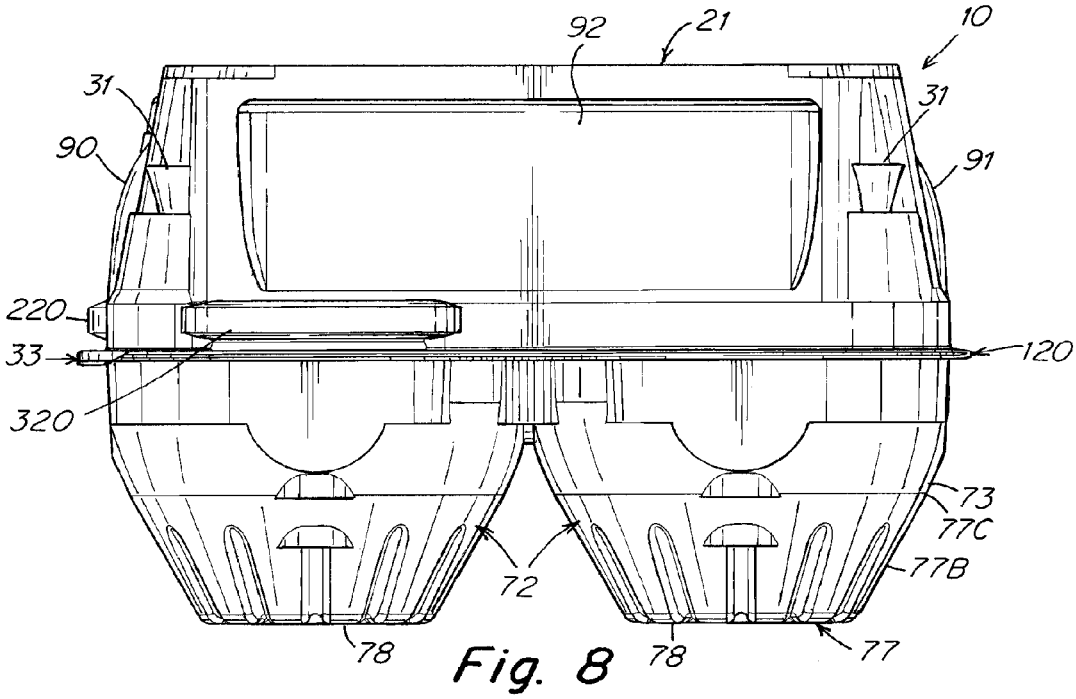
FIG. 8 is a right side elevational view of the closed carton of FIG. 3.
Figure 9:
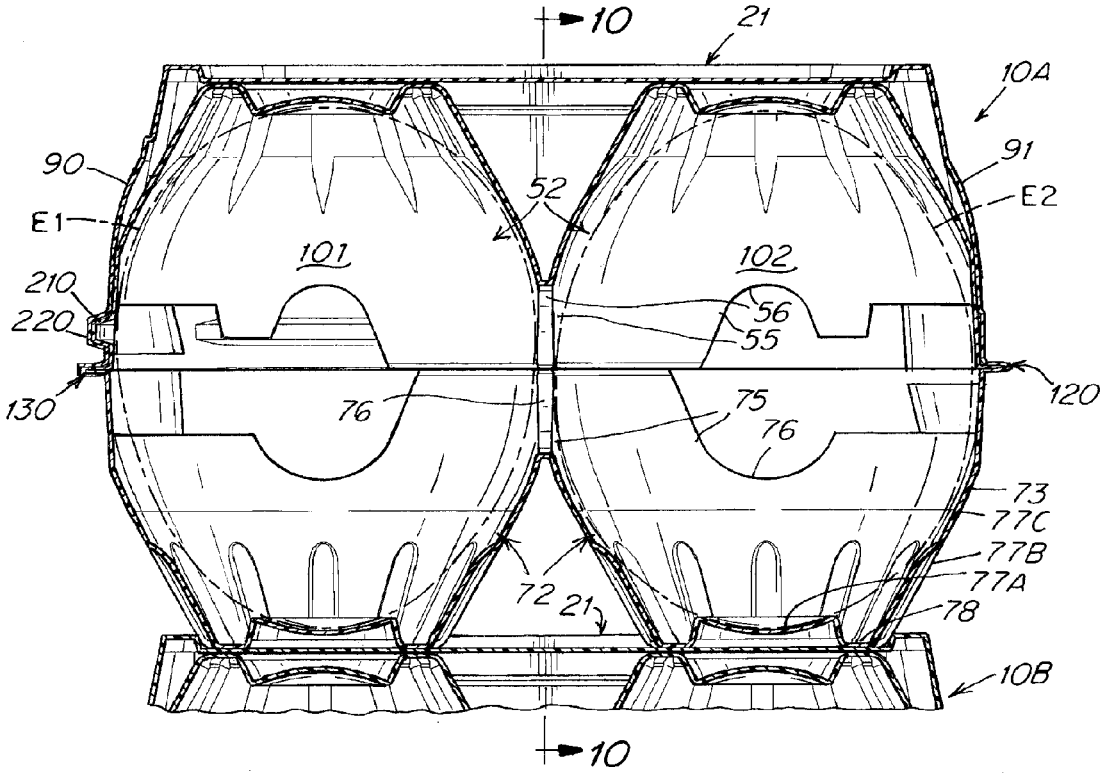
FIG. 9 is a cross sectional side view taken along section line 9-9 of FIG. 4; egg E1 is shown in the oriented egg position and egg E2 in the non-oriented egg position.
Figure 10:
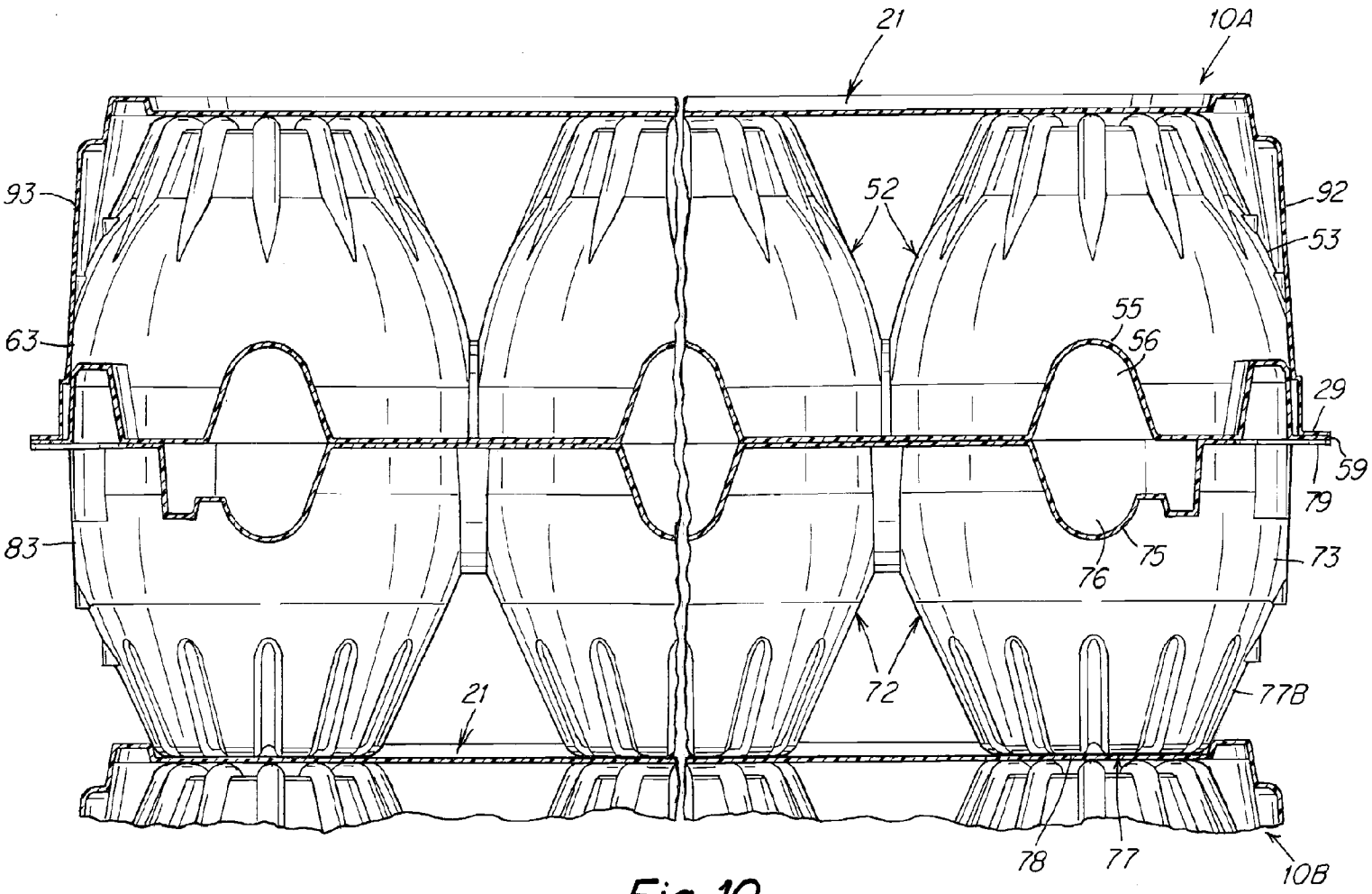
FIG. 10 is a fragmented cross sectional front view taken along line 10-10 of FIG. 9.

FIGS. 8-10 illustrate these sidewall and end wall lid protrusions 90-93, and their ability to accommodate larger size cell pockets, as shown in the cross-sectional view of FIG. 9. Eggs E are shown in each of the two adjacent cell pockets 101, 102 of FIG. 9; on the left, the egg is in an unoriented position (narrow point end facing down) and on the right the egg is on an oriented position (narrow point end facing up). In both cases the enlarged cell pocket can accommodate the widest girth (width) of the egg.

Figure 11:
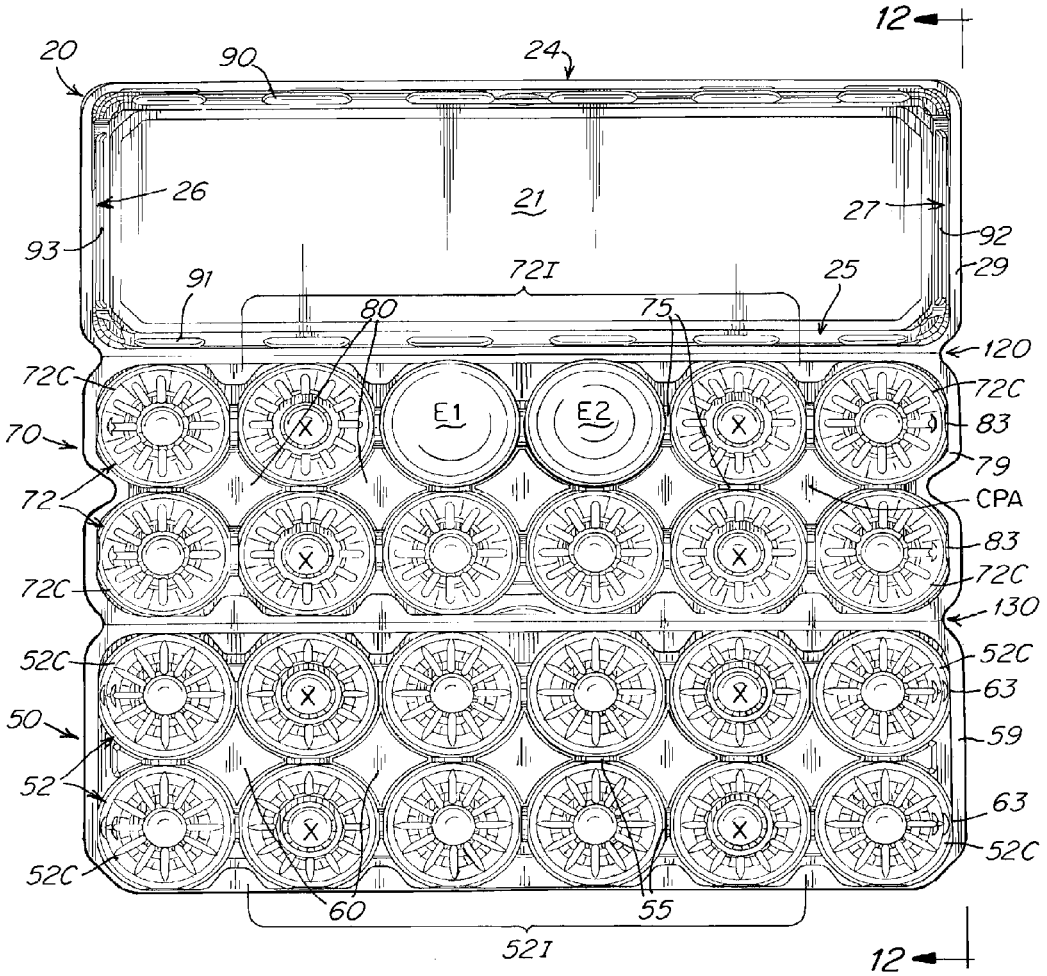
FIG. 11 is a top plan view of the egg carton of FIG. 1 in a fully open position.

Returning to FIGS. 1-2, and in the top plan view of FIG. 11 of a fully open carton, the cell structure will be further described. The twelve cells 52 of the 2×6 cell matrix in the base 70 are each generally cup shaped and formed as either a corner cell 72C or an interior cell 721 (see FIG. 11). The twelve cells 52 of the cover 50 are similarly shaped and arranged, such that in the assembled state the aligned cell pairs of the cover and base form cell pockets 101, 102 for holding 12 eggs, each in an individual cell pocket. The egg carton 10 has a 2×6 matrix of cell pockets (2 rows of 6 cells per row), with two end cells (52C, 72C) adjacent each end of the carton, and six cells in a row aligned along the front sidewall or rear sidewall respectively.

Referring to FIGS. 1, 2, and 8-12, each of the base cells 72 is formed with a tubular sidewall 73 having circumferential joined wall portions to define an inner receiving surface 74 contoured to receive the ovoid shape of an egg. Each of the sidewall is arcuately formed in two coordinate directions to define the necessary ovoid contour. Each sidewall 73 extends upwardly to define an open top end, and where there is an adjoining cell 72, joins with the sidewall 73 of the adjoining cell 72, with the two side walls 73, 73 cooperatively defining a cell divider 75. The cell divider has a generally rounded opening 76 between the two adjacent cells.

A cell post 80 is formed at each intersection (i.e., cross-hair) of four adjacent (2×2 matrix of) cells 72 in the base, the cell post comprising an extension of the intersecting side walls of the four cells, and having a generally flat top cell post wall 81 disposed substantially in the same plane C as the uppermost base perimeter (peripheral surface 79). The cell post has a central axis CPA that extends axially down the center of the cell post and is aligned with the height direction of the carton. The cell post is generally tubular in shape and typically hollow. Typically, axis CPA is disposed laterally (about 90°) to the bottom plane BP of the carton 10 on which the bottommost extending surfaces 78 of the egg cells of the base rest (FIG. 4). The cover 50 has similarly shaped cells 52 each having a tubular side wall 53, cell dividers 55, and cell posts 60, as the base, and will not be separately described. The flat tops 81, 61 of the cell post walls of the base and cover are configured to mate (engage in planar relation) when the cover is closed over the base, to support the assembled carton and provide compressive strength in the height direction H.

The sidewall 73 of each of base cell 72 extends downwardly to a substantially planar base 77 (FIGS. 8-9). On its interior surface, the base has a centrally located cup shaped contour 77A for receiving one end of the egg. A radially outwardly and upwardly tapered wall surface 77B surrounds the central cup portion of the base. At the upper edge 77C of the tapered portion a generally circular cylindrical sidewall portion 73 of the cell accommodates the widest girth of the egg. Four cell bottoms (marked X in FIG. 11) on each of the base and cover have a smoothed out bottom to adhere to suction cups for de-nesting.

In accordance with another feature of the present invention, flats 63, 83 are added to the sidewalls of the end cells 52C, 72C of both the cover and base respectively to increase the peripheral mating surface area 59, 79 and increase the compressive strength of the assembled carton (see FIG. 1 and cross sectional view of FIG. 10).

A further feature of the invention is the provision of varying height cell dividers of the base. As best shown in FIGS. 9-11, the rounded opening 76 above the cell divider 75 between adjoining cells 72, 72 has three different depths; the cell dividers closest to the center line CL of the carton (extending transverse to length L as shown in FIG. 1) have the smallest opening (greatest cell divider height), and the cells closest to the end walls having the deepest opening (lowest cell divider height). This gradation in the size of the openings from the centermost cell outwardly to the end cell, helps stabilize the closed carton during transport. In one example, the depth (in the height direction) of the shortest cell divider is 13/32 inches, that of the middle cell divider is 15/32 inches, and that of the end cell divider is 17/32 inches. In various embodiments, the cell divider heights may range in size from ¼ to 11/16 inches.

Figure 15A:
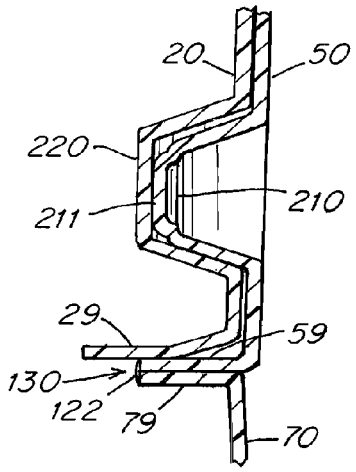
FIG. 15A is a cross sectional detailed view of a fully closed front latch taken along line 15A-15A of FIG. 15.

FIGS. 15-17 illustrate a further feature of the invention, for improved locking of the assembled carton. As best shown in FIGS. 2 and 15-15A, elongated front latches 210, aligned in the length L direction, are provided on the exterior of the front-facing cover wall (adjacent the interior of the closed lid front wall 24), the latches 210 having vertical ridges 211 (aligned in the height H direction) through them to provide additional strength to the latch. FIG. 15A shows a cross sectional view of a fully closed front latch taken along line 15A-15A of FIG. 15. The outwardly extending ridges 211 engage an inner surface of a mating projecting latch portion 220 of the lid, while the flat peripheral surface 29 of the lid rests on the mating peripheral surfaces 59, 79 of the cover and base. The assembled carton is thus held securely in the closed position. FIG. 15 further shows mating latches 320, 310 on the end walls of the lid and cover respectively. These further secure the carton in the assembled state. In the present embodiment, the front and side latches 210, 310 on the cover each comprise a substantially elongated protrusion extending outwardly and aligned generally parallel to the common base plane BP on which the carton rests. The mating latches 220, 320 on the lid extend further outwardly and receive (lie over) the cover latches 210, 310.

FIGS. 4-5 show front and rear elevational views of the closed carton, with the lower most exterior surfaces 78 of each cell base 72 resting on a common base plane BP. The front wall protrusions 90 and side wall protrusions 92, 93 in the lid are shown clearly in FIGS. 4-5, along with the corner stack lug 31 and the front lid finger tabs 33. FIG. 6 is a top plan view showing the same features from above. FIG. 7 is a bottom plan view of the closed carton, showing the exterior surfaces of the cells 72 of the base, including a substantially circular standing ring 78 on the exterior of each cell base on which the carton rests. In one embodiment, one or more of the cell bases have a smooth exterior central portion to facilitate vacuum pickup of the carton, during processing. FIG. 11 shows a top plan view of the interior surfaces of the base and cover cells. FIG. 10 is a fragmented sectional view showing the bottom of a top carton 10A stacked on the lid of a bottom carton 10B (partial view).

Figure 12:
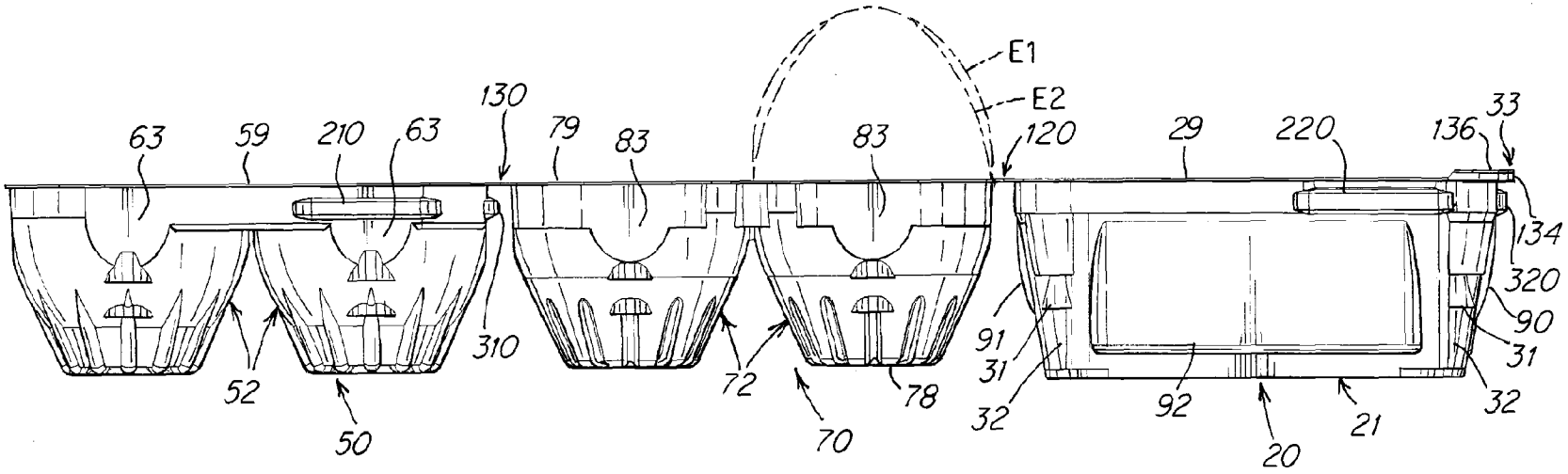
FIG. 12 is a right side elevational view of the open carton of FIG. 11 as seen along line 12-12 of FIG. 11.

FIG. 12 is a right side elevational view of the open carton of FIG. 11, as seen along line 12-12. An egg E is shown disposed in one cell 72 of the base. The lid protrusions 90-92 and flats 63, 83 on the exterior cell pocket sidewalls are shown.

Figures 13, 13A, 13B:
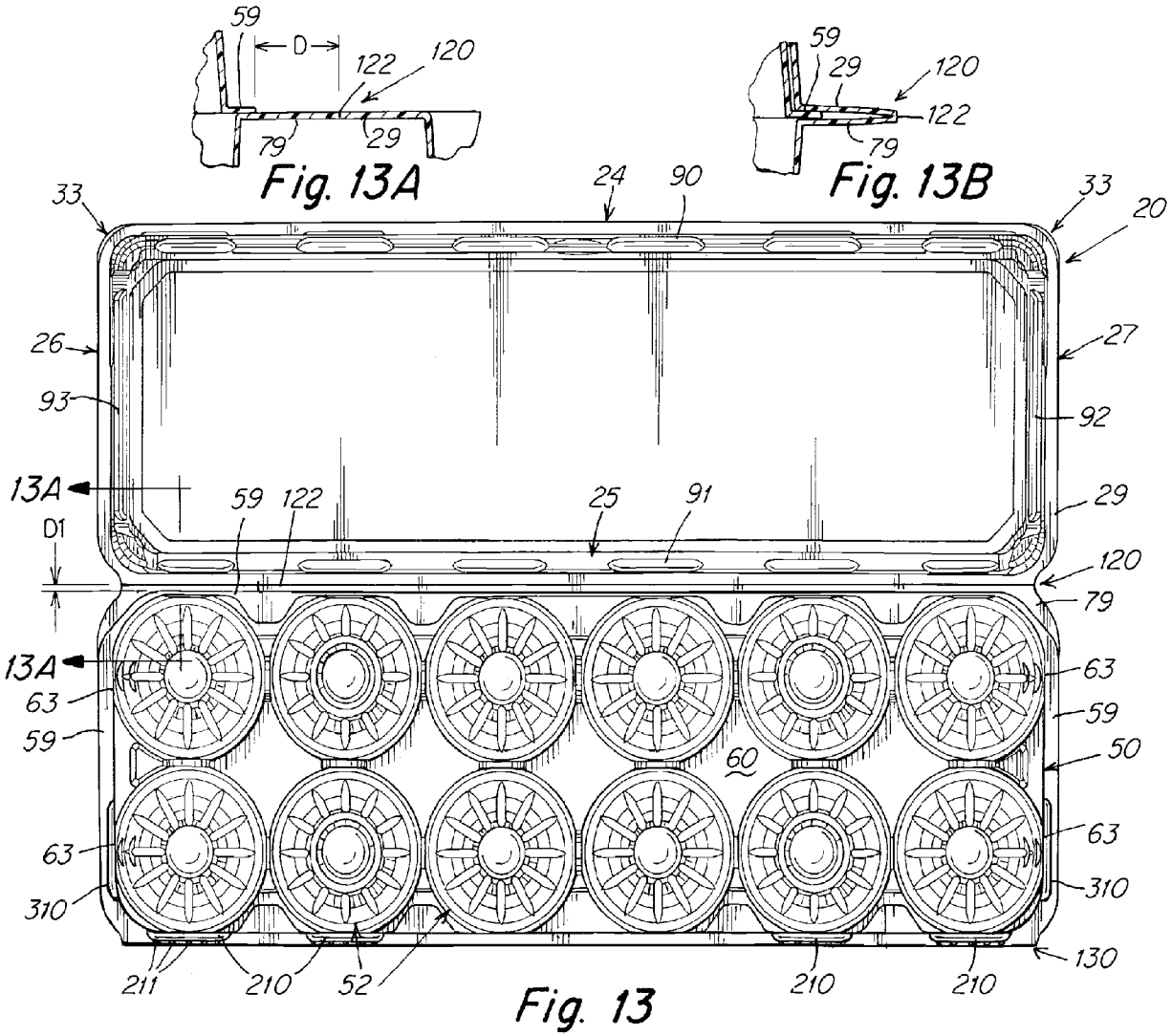
FIG. 13 is a top plan view of the carton of FIG. 12 in a semi-closed position (with the cover closed over the base)
FIG. 13A is a cross sectional view of the open hinge area taken along line 13A-13A of FIG. 13.
FIG. 13B is a cross sectional view similar to FIG. 13A but showing the fully closed position of the hinge area.

FIG. 13 is a top plan view of the carton in a semi-closed position, with the cover 50 closed over the base 70. Here the width of the flat peripheral mating surface 59 on the free (unhinged) elongated edge of the cover, which lies adjacent the lid-base hinge 120, has been limited (shortened) to extend a distance D1, in order to better accommodate and prevent obstruction of the lid-base hinge 122 when closed. The distance D1 may vary, for example in a range of 0.040 to 0.135 inches. FIG. 13A is a cross section of the lid-base hinge area 120 in the open condition, showing the distance D1. FIG. 13B is a cross sectional view similar to FIG. 13A but showing the same hinge area 120 where the lid is fully closed over the base and cover.

In the present embodiment, the assembled carton holds 12 jumbo eggs in a 2×6 matrix of cell pockets and has an overall length L of from about 11.62 to about 11.75 inches, a width W of from about 3.95 to about 4.00 inches, and height H of from about 2.62 to about 2.75 inches.

In one embodiment, the carton may be designed to securely and easily allow the loading of larger jumbo eggs, while protecting twelve full-sized jumbo eggs, and can be effectively processed and packaged within standard corrugated one-half and full cases along with standard one-half case plastic or metal baskets used within the egg industry (i.e., no special cases or baskets are required). A total of thirty dozen tri-fold egg cartons will fit into a standard full case and fifteen dozen tri-fold egg cartons will fit into a standard half case, whereas previously only twelve dozen jumbo egg cartons fit into a half case or basket. The tri-fold egg cartons are processed to automated labeling equipment and egg processing equipment. The full case has inner dimensions of about: 23⅞ inches×11⅞ inches×13¾ inches. The 15-dozen half case container has inner dimensions of about: 11⅞ inches×11⅞ inches×13⅝ inches.

The egg carton is formed by thermoforming from a single sheet of thermoformable material. In various embodiments, the plastic material of the egg carton is preferably one or more of polystyrene (e.g., polystyrene foam), polyester (e.g., polyethylene terephthalate (PET)), polyolefin (e.g., polyethylene (PE), polypropylene (PP)), or poly(lactic acid) (PLA), including homopolymers, copolymers, mixtures and blends thereof, and including virgin and reclaimed (recycled) materials. In one example, the material is a clear solid sheet, such as a polyester, e.g, polyethylene terephthalate. In another example, the thermoformable is polystyrene foam. Environmentally favorable "green materials," in both solid or foam may be used.

As is readily apparent, numerous modifications and changes may readily occur to those skilled in the art. Hence, it is not desired to limit the invention to the exact construction and operation shown and described, and accordingly suitable modification equivalents may be considered to fall within the scope of the invention as claimed.

What is claimed is:

1. A tri-fold plastic egg carton for accommodating jumbo eggs, in both oriented and non-oriented positions, in individual cell pockets comprising:

a cell base, a cell cover and lid, wherein the egg carton can be assembled in a closed position having a length, a width and a height with the cell cover closed over the base and the lid closed over the cell cover;

the cell base having opposing elongated edges aligned along the length of the carton;

the cell cover having a hinged connection to one of the elongated edges of the cell base for pivoting between open and closed positions with respect to the cell base, the base and cover each having a complementary matrix of cells that together form a matrix of cell pockets for holding individual eggs when the cover is closed over the base, each cell pocket having a largest diameter portion transverse to the carton height to accommodate a jumbo egg in the cell pocket when the cell cover is closed over the cell base;

the lid having a hinged connection to the other elongated edge of the base for pivoting between open and closed positions, wherein when the cover and base are in the closed position the lid can be closed over the cover to form the carton in the closed position;

the lid having a top wall, depending front and rear sidewalls aligned along the length of the carton, and depending end walls aligned along the width at opposite ends of the carton;

lid sidewall protrusions spaced apart along the front and rear sidewalls of the lid, each lid sidewall protrusion extending over the largest diameter portion of the cell pocket when the lid is closed over the cover and base.

2. The egg carton of claim 1, wherein the egg carton has lid end wall protrusions extending over the largest diameter portion of the cell pocket when the lid is closed over the cover and base.

3. The egg carton of claim 2, wherein the lid end wall protrusions each accommodate two cell pockets adjacent one end of the matrix of cell pockets.

4. The egg carton of claim 3, wherein each lid end wall protrusion has a flat area for printing at the end of the carton comprising of from about 65% to about 75% of the total end wall area of both end walls.

5. The egg carton of claim 1, wherein the matrix is a 2×6 matrix and the lid sidewall protrusions include six protrusions along each of the lid front and rear sidewalls.

6. The egg carton of claim 1, wherein the egg carton is a unitary sheet of thermoformed plastic material.

7. The egg carton of claim 1, wherein cell posts are disposed at each intersection of four adjacent cells in the matrix in each of the cover and base, and each cell post of the base has a top surface that mates with a complementary top surface of the cell post of the cover when the cover is closed over the base.

8. The egg carton of claim 7, wherein the top surfaces of the cell posts have mating flat areas.

9. The egg carton of claim 1, wherein the base and cover have flat peripheral mating surfaces that engage in planar relation when the cover is closed over the base.

10. The egg carton of claim 9, wherein the lid has a flat peripheral mating surface that lies over and engages in planar relation the flat peripheral mating surfaces of the closed cover and base.

11. The egg carton of claim 10, wherein the lid sidewalls extend from the lid top wall to the lid peripheral mating surface, and the lid has rounded corners between the lid sidewalls and lid end walls, each rounded corner having an outwardly disposed stack lug provided in a mid-portion of the rounded corner between the lid peripheral mating surface and the lid top wall.

12. The egg carton of claim 11, wherein each rounded corner has an outwardly cupped cylindrical portion, recessed with respect to the stack lug, between the stack lug and the lid top wall.

13. The egg carton of claim 12, wherein the flat peripheral mating surface of the cover, lying adjacent the hinged connection between the base and lid when the cover is closed over the base, is spaced from the hinged connection to provide clearance for closing the lid over the cover and base.

14. The egg carton of claim 10, wherein the lid corners between the front sidewall and the two end walls each have a lip tab extending from the flat peripheral mating surface, each lip tab having a first wall that extends generally transverse to the flat peripheral mating surface to restrain movement of the base with respect to the cover in the closed position, and a second wall that extends from the first wall to form a finger tab for moving the lid to an open position away from the closed cover and base.

15. The egg carton of claim 9, wherein each cell of the cover and base has a rounded sidewall portion adapted to engage an egg, and a flat is provided in the sidewall of each cell adjacent an end wall to increase the width of the adjacent flat peripheral mating surfaces of the closed cover and base.

16. The egg carton of claim 1, wherein the front sidewall of the lid has a plurality of elongated latches aligned along the length of the lid for engaging complementary latch surfaces on the closed cover and base, and wherein the lid latches have generally transverse ridges strengthening the latches.

17. The egg carton of claim 1, wherein each cell has a sidewall and the sidewalls of two adjacent cells form a cell divider to prevent contact between eggs in adjacent cell pockets.

18. The egg carton of claim 17, wherein the cell dividers in the base are of varying height along the length of the carton, the base cell dividers closer to the ends of the carton having a lesser height relative to the base cell dividers closer to the middle of the carton.

19. The egg carton of claim 1, wherein the closed carton is sized to accommodate jumbo size eggs of between 2.50 and 2.75 ounces per egg.

20. The egg carton of claim 1, wherein the plastic is one or more of polystyrene, polyester, polyethylene, and polylatic acid, including polymers, copolymers, mixtures and blends thereof.

21. The egg carton of claim 1, wherein the carton comprises a clear solid thermoformed sheet of polyester.

22. The egg carton of claim 1, wherein the carton comprises a thermoformed sheet of polystyrene foam.

23. The egg carton of claim 1, wherein the matrix is a 2×6 matrix of cells for accommodating 12 jumbo eggs.

24. The egg carton of claim 1, wherein the matrix is a 2×N matrix where N is one of 2, 3, 4, 5, and 6.

25. A tri-fold plastic egg carton for accommodating jumbo eggs, in both oriented and non-oriented positions, in individual cell pockets comprising:

a cell base, a cell cover and lid, wherein the egg carton can be assembled in a closed position having a length, a width and a height with the cell cover closed over the cell base and the lid closed over the cell cover;

the cell base having opposing elongated edges aligned along the length of the carton;

the cell cover having a hinged connection to one of the elongated edges of the cell base for pivoting between open and closed positions with respect to the cell base, the base and cover each having a complementary matrix of cells that together form a matrix of cell pockets for holding individual eggs when the cover is closed over the base, each cell pocket having a largest diameter portion transverse to the carton height to accommodate a jumbo egg in the cell pocket when the cell cover is closed over the cell base;

the lid having a hinged connection to the other elongated edge of the base for pivoting between open and closed positions, wherein when the cover and base are in the closed position the lid can be closed over the cover to form the assembled carton in the closed position;

the lid having a top wall, depending front and rear sidewalls aligned along the length of the carton, and depending end walls aligned along the width at opposite ends of the carton;

the lid having rounded corners between the lid sidewalls and end walls, the base and cover having flat peripheral mating surfaces that engage in planar relation when the cover is closed over the base, the lid having a flat peripheral mating surface that lies over and engages in planar relation the flat peripheral mating surfaces of the closed cover and base, and wherein the lid corners between the front sidewall and the two end walls each have a lip tab extending from the flat peripheral mating surface of the lip, each lip tab having a first wall that extends generally transverse to the flat peripheral mating surface to restrain movement of the base with respect to the cover in the closed position, and a second wall that extends from the first wall to form a finger tab for moving the lid to an open position away from the closed cover and base.

* * * * *

UNITED STATES PATENT AND TRADEMARK OFFICE

CERTIFICATE OF CORRECTION

PATENT NO. : 9,169,058 B1
APPLICATION NO. : 14/460837
DATED : October 27, 2015
INVENTOR(S) : Ramirez et al.

It is certified that error appears in the above-identified patent and that said Letters Patent is hereby corrected as shown below:

In the claims,

In column 14, line 18 (claim 25):

delete “lip” and replace with -- lid --

Signed and Sealed this
Tenth Day of May, 2016

Michelle K. Lee

Michelle K. Lee
*Director of the United States Patent and Trademark Office*